US011302343B2

(12) United States Patent
Ito et al.

(10) Patent No.: US 11,302,343 B2
(45) Date of Patent: Apr. 12, 2022

(54) SIGNAL ANALYSIS DEVICE, SIGNAL ANALYSIS METHOD, AND SIGNAL ANALYSIS PROGRAM

(71) Applicant: NIPPON TELEGRAPH AND TELEPHONE CORPORATION, Tokyo (JP)

(72) Inventors: Nobutaka Ito, Musashino (JP); Tomohiro Nakatani, Musashino (JP); Shoko Araki, Musashino (JP)

(73) Assignee: NIPPON TELEGRAPH AND TELEPHONE CORPORATION, Tokyo (JP)

( * ) Notice: Subject to any disclaimer, the term of this patent is extended or adjusted under 35 U.S.C. 154(b) by 0 days.

(21) Appl. No.: 16/980,428

(22) PCT Filed: Apr. 4, 2019

(86) PCT No.: PCT/JP2019/015041

§ 371 (c)(1),
(2) Date: Sep. 14, 2020

(87) PCT Pub. No.: WO2019/194300

PCT Pub. Date: Oct. 10, 2019

(65) Prior Publication Data

US 2020/0411027 A1 Dec. 31, 2020

(30) Foreign Application Priority Data

Apr. 5, 2018 (JP) ..... JP2018-073471

(51) Int. Cl.
*G10L 21/028* (2013.01)
*G10L 25/51* (2013.01)

(52) U.S. Cl.
CPC ..... *G10L 21/028* (2013.01); *G10L 25/51* (2013.01)

(58) Field of Classification Search
CPC ..... G10L 21/08; G10L 25/51
See application file for complete search history.

(56) References Cited

U.S. PATENT DOCUMENTS

2013/0096922 A1* 4/2013 Asaei ..... G01S 3/8006 704/270
2017/0192083 A1* 7/2017 Avitzour ..... G01S 5/0215

OTHER PUBLICATIONS

Souden, M., Araki, S., Kinoshita, K., Nakatani, T., & Sawada, H. (Sep. 2011). Simultaneous speech source separation and noise reduction via clustering and MMSE-based filtering. In 2011 IEEE International Conference on Signal Processing, Communications and Computing (ICSPCC) (pp. 1-6). IEEE.*

(Continued)

*Primary Examiner* — Bryan S Blankenagel
(74) *Attorney, Agent, or Firm* — Xsensus LLP

(57) ABSTRACT

A signal analysis device includes an estimation unit that models a sound source position occurrence probability matrix Q using a product of a sound source position probability matrix B and a sound source existence probability matrix A, and estimates at least one of the sound source position probability matrix B and the sound source existence probability matrix A based on the modeling, the sound source position occurrence probability matrix Q being composed of probabilities of arrival of a signal from each sound source position candidate per frame, which is a time section, with respect to a plurality of sound source position candidates. The sound source position probability matrix B being composed of probabilities of arrival of a signal from each sound source position candidate per sound source with respect to a plurality of sound sources.

8 Claims, 8 Drawing Sheets

(56) References Cited

OTHER PUBLICATIONS

Chong, N. E. H. (2015). An Online Solution for Localisation, Tracking and Separation of Moving Speech Sources (Doctoral dissertation, Curtin University).*

N. Ito, et al., "Probabilistic Spatial Dictionary Basedonline Adaptive Beamforming Formeeting Recognition in Noisy Andreverberant Environments", 2017 ICASSP, Mar. 5, 2017, pp. 681-685.

* cited by examiner

SIGNAL ANALYSIS DEVICE, SIGNAL ANALYSIS METHOD, AND SIGNAL ANALYSIS PROGRAM

CROSS-REFERENCE TO RELATED APPLICATIONS

The present application is based on PCT filing PCT/JP2019/015041, filed Apr. 4, 2019, which claims priority to JP 2018-073471, filed Apr. 5, 2018, the entire contents of each are incorporated herein by reference.

TECHNICAL FIELD

The present invention relates to a signal analysis device, a signal analysis method, and a signal analysis program.

BACKGROUND ART

There is a diarization technique that, in a situation where N' sound source signals coexist (where N' is an integer equal to or larger than 0), determines whether each sound source is producing sound at each time from a plurality of observation signals that have been obtained at different positions. It is considered that N' is the true number of sound sources, and N is the assumed number of sound sources. It is considered that N, which is the assumed number of sound sources, is set to be sufficiently large so as to be equal to or larger than the true number of sound sources N'. Specifically, assuming the use in a speech conference and the like, when 6 conference seats are prepared, it is sufficient to set N=6 as the assumed maximum number of participants is 6. Note that when the actual number of participants is 4, N'=4.

CITATION LIST

Non Patent Literature

[NPL 1] N. Ito, S. Araki, M. Delcroix, and T. Nakatani, "PROBABILISTIC SPATIAL DICTIONARY BASED ONLINE ADAPTIVE BEAMFORMING FOR MEETING RECOGNITION IN NOISY AND REVERBERANT ENVIRONMENTS", in Proceedings of International Conference on Acoustics, Speech, and Signal Processing (ICASSP), March 2017.

SUMMARY OF THE INVENTION

Technical Problem

A description is now given of a conventional diarization device using FIG. 7. FIG. 7 is a figure showing a configuration of a conventional diarization device. As shown in FIG. 7, a conventional diarization device 1P includes a frequency domain conversion unit 11P, a feature extraction unit 12P, a storage unit 13P, a sound source position occurrence probability estimation unit 14P, and a diarization unit 15P.

The frequency domain conversion unit 11P receives input observation signals $y_m(\tau)$, and calculates observation signals $y_m(t,f)$ in a time-frequency domain using, for example, short-time Fourier transform. Here, $\tau$ denotes a sample point index, t=1, . . . , T denotes a frame index, f=1, . . . , F denotes a frequency bin index, and m=1, . . . , M denotes a microphone index. It is considered that M microphones are placed at different positions.

The feature extraction unit 12P receives the observation signals $y_m(t,f)$ in the time-frequency domain from the frequency domain conversion unit 11P, and calculates a feature vector z(t,f) related to a sound source position for each time-frequency point (expression (1)).

[Formula 1]

$$z(t, f) = \frac{y(t, f)}{\|y(t, f)\|_2} \tag{1}$$

Note that y(t,f) is expression (2), and $\|y(t,f)\|_2$ is expression (3). A feature vector z(t,f) is a unit vector indicating the direction of an observation signal vector y(t,f).

[Formula 2]

$$y(t, f) = (y_1(t, f) \ \dots \ y_M(t, f))^T \tag{2}$$

[Formula 3]

$$\|y(t, f)\|_2 = \sqrt{\sum_{m=1}^{M} |y_m(t, f)|^2} \tag{3}$$

With the conventional technique, it is assumed that each sound source signal arrives from one of K sound source position candidates, and these sound source position candidates are represented by an index (hereinafter, "sound source position index") k=1, . . . , K. FIG. 8 is a figure illustrating position candidates of speakers in a case where the use in a speech conference is assumed. For example, in a situation where a plurality of speakers are having a conversation while being seated around a table 20, k points by which the periphery of the table is finely divided (where k=1, . . . , K) can be used as sound source position candidates as shown in FIG. 8. Note that in FIG. 8, "array" denotes M microphones, n denotes sound source (speaker) indexes, and N denotes the assumed number of sound sources (speakers).

With the conventional technique, it is assumed that each sound source signal is sparse, that is to say, each sound source signal holds significant energy only at a small number of time-frequency points. For example, it is known that a speech signal satisfies this assumption relatively well. Under the assumption of this sparse property, it is rare that different sound source signals overlap at each time-frequency point, and thus an observation signal can be approximated to be composed of only one sound source signal at each time-frequency point. While a feature vector z(t,f) is a unit vector indicating the direction of an observation signal vector y(t,f) as mentioned earlier, this takes a value corresponding to a sound source position of a sound source signal included in an observation signal at a time-frequency point (t,f) under the aforementioned approximation based on the sparse property. Therefore, a feature vector z(t,f) conforms to different probability distributions in accordance with a sound source position of a sound source signal included in an observation signal at a time-frequency point (t,f).

In view of this, the storage unit 13P stores probability distributions $q_{kf}$ of feature vectors z(t,f) for respective sound source position candidates k and respective frequency bins f (k=1, . . . , K, f=1, . . . , F). Here, as a probability distribution of a feature vector z(t,f) of expression (1) takes different forms of distribution depending on the frequency bins f, it is assumed that the probability distributions $q_{kf}$ are dependent on the frequency bins f.

The sound source position occurrence probability estimation unit 14P receives the feature vectors z(t,f) from the feature extraction unit 12P and the probability distributions $q_{kf}$ from the storage unit 13P, and estimates sound source position occurrence probabilities $\pi_k(t)$ which represent a probability distribution of sound source position indexes per frame.

A sound source position occurrence probability $\pi_k(t)$ obtained by the sound source position occurrence probability estimation unit 14P can be regarded as the probability of sound arrival from the $k^{th}$ sound source position candidate in the $t^{th}$ frame. Therefore, in each frame t, a sound source position occurrence probability $\pi_k(t)$ takes a large value with a value of k corresponding to a sound source position of a sound source signal that is producing sound, and takes a small value with other values of k.

For example, when only one sound source signal is producing sound in a frame t, the sound source position occurrence probability $\pi_k(t)$ takes a large value with a value of k corresponding to a sound source position of this sound source signal, and takes a small value with other values of k. Also, when only two sound source signals are producing sound in a frame t, the sound source position occurrence probability $\pi_k(t)$ takes a large value with values of k corresponding to sound source positions of these sound source signals, and takes a small value with other values of k. Therefore, by detecting a peak of the sound source position occurrence probabilities $\pi_k(t)$ in a frame t, a sound source position of sound produced in the frame t can be detected.

In view of this, the diarization unit 15P determines whether each sound source is producing sound in each frame (that is to say, performs diarization) based on the sound source position occurrence probabilities $\pi_k(t)$ from the sound source position occurrence probability estimation unit 14P.

Specifically, the diarization unit 15P first detects a peak of the sound source position occurrence probabilities $\pi_k(t)$ on a per-frame basis. As stated earlier, this peak corresponds to a sound source position of sound that is being produced in the pertinent frame. Under the assumption that a correspondence relationship between sound source position candidates and sound sources, which indicates to which sound source each of the sound source position candidates 1, . . . , K correspond, is known, the diarization unit 15P further performs diarization by determining that, in each frame t, a sound source corresponding to a value of a sound source position index k whose sound source position occurrence probability $\pi_k(t)$ represents a peak is producing sound, and other sound sources are not producing sound.

Note that, in the foregoing, it is assumed that a correspondence relationship between sound source position candidates and sound sources is known. For example, when rough estimated values of sound source positions of respective sound sources are given, the aforementioned correspondence relationship can be obtained based thereon (it is sufficient to associate each sound source position candidate with the nearest sound source).

However, the conventional diarization device first estimates the sound source position occurrence probabilities $\pi_k(t)$, and then performs diarization based on the sound source position occurrence probabilities $\pi_k(t)$. At this time, although the sound source position occurrence probabilities $\pi_k(t)$ are optimally estimated using a maximum likelihood method, diarization is based on heuristics and is not optimal. Also, with the conventional diarization device, sound source positions of respective sound source signals are considered to be known, and sound source localization cannot be performed.

With the foregoing in view, it is an object of the present invention to provide a signal analysis device, a signal analysis method, and a signal analysis program that enable the execution of optimal diarization or the execution of appropriate sound source localization.

Means for Solving the Problem

To solve the aforementioned problem and achieve the object, a signal analysis device of the present invention is characterized by including an estimation unit that models a signal source position occurrence probability matrix Q using a product of a signal source position probability matrix B and a signal source existence probability matrix A, and estimates at least one of the signal source position probability matrix B and the signal source existence probability matrix A based on the modeling, the signal source position occurrence probability matrix Q being composed of probabilities of arrival of a signal from each signal source position candidate per frame, which is a time section, with respect to a plurality of signal source position candidates, the signal source position probability matrix B being composed of probabilities of arrival of a signal from each signal source position candidate per signal source with respect to a plurality of signal sources, the signal source existence probability matrix A being composed of existence probabilities of a signal from each signal source per frame.

Effects of the Invention

According to the present invention, the execution of optimal diarization or the execution of appropriate sound source localization is enabled.

DESCRIPTION OF EMBODIMENTS

An embodiment of a signal analysis device, a signal analysis method, and a signal analysis program according to the present application will be described below in detail based on the figures. Also, the present invention is not limited by the embodiment described below. Note that hereinafter, the notation "^A" with respect to A which is a vector, a matrix, or a scalar is considered to be the same as "a sign represented by 'A' with '^' written immediately thereabove". Also, the notation "~A" with respect to A which is a vector, a matrix, or a scalar is considered to be the same as "a sign represented by 'A' with '~' written immediately thereabove".

First Embodiment

First, a signal analysis device according to a first embodiment will be described. Note that in the first embodiment, it is considered that in a situation where N' sound source signals coexist (where N' is an integer equal to or larger than 0), M observation signals $y_m(\tau)$ (m=1, . . . , M denotes a microphone index, and $\tau$ denotes a sample point index) that have been obtained by microphones at different positions are input to the signal analysis device (where M is an integer equal to or larger than 2).

Note that a "sound source signal" in the present first embodiment may be a target signal (e.g., speech), or may be directional noise (e.g., music played on a TV), which is noise arriving from a specific sound source position. Also, diffusive noise, which is noise arriving from various sound source positions, may be collectively regarded as one "sound source signal". Examples of diffusive noise include speaking voices of many people in crowds, a café, and the like, sound of footsteps in a station or an airport, and noise attributed to air conditioning.

Figure 1:
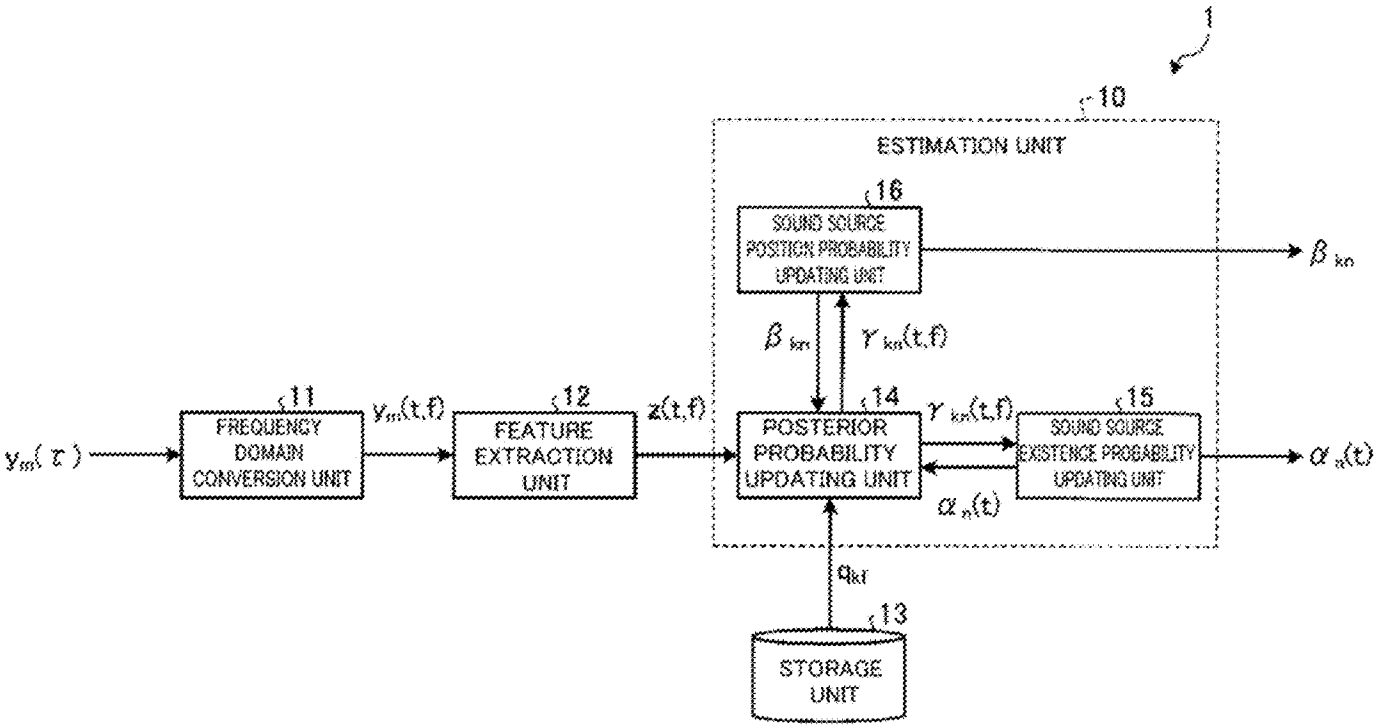
FIG. 1 is a figure showing one example of a configuration of a signal analysis device according to a first embodiment.
Figure 2:
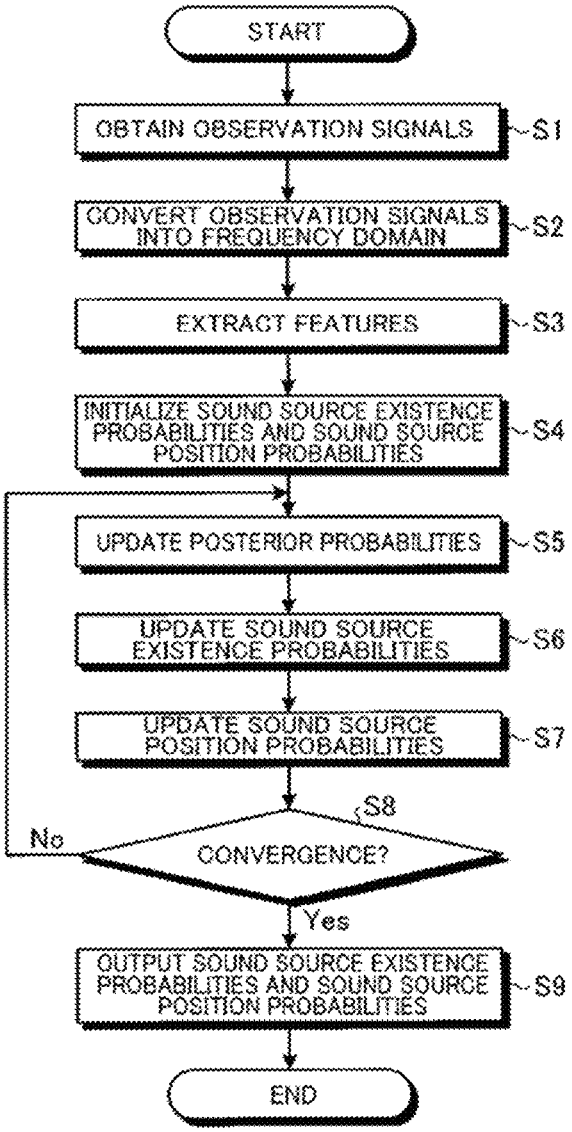
FIG. 2 is a flowchart showing one example of a processing procedure of signal analysis processing according to the first embodiment.

A configuration and processing of the first embodiment will be described using FIG. 1 and FIG. 2. FIG. 1 is a figure showing one example of a configuration of the signal analysis device according to the first embodiment. FIG. 2 is a figure showing one example of processing of the signal analysis device according to the first embodiment. A signal analysis device 1 according to the first embodiment is realized as, for example, a predetermined program is read into a computer and the like including a ROM (Read Only Memory), a RAM (Random Access Memory), a CPU (Central Processing Unit), and the like, and the CPU executes the predetermined program.

As shown in FIG. 1, a signal analysis device 1 includes a frequency domain conversion unit 11, a feature extraction unit 12, a storage unit 13, an initializing unit (not shown), an estimation unit 10, and a convergence determination unit (not shown).

First, an overview of respective units of the signal analysis device 1 will be described. The frequency domain conversion unit 11 obtains input observation signals $y_m(\tau)$ (step S1), and obtains observation signals $y_m(t,f)$ in a time-frequency domain by converting the observation signals $y_m(\tau)$ into a frequency domain using, for example, short-time Fourier transform (step S2). Here, t=1, . . . , T denotes a frame index, and f=1, . . . , F denotes a frequency bin index.

The feature extraction unit 12 receives the observation signals $y_m(t,f)$ in the time-frequency domain from the frequency domain conversion unit 11, and calculates a feature vector related to a sound source position (expression (4)) for each time-frequency point (step S3).

[Formula 4]

$$z(t,f) \tag{4}$$

Note that when feature amounts are unidimensional, z(t,f) is a scalar and can be naturally regarded as a unidimensional vector as well; thus, in this case also, z(t,f) is indicated using a boldface z in expressions (see expression (5)) and referred to as a feature vector.

[Formula 5]

$$z(t,f) \tag{5}$$

In the present embodiment, it is assumed that each sound source signal arrives from one of K sound source position candidates, and these sound source position candidates are represented by indexes (hereinafter, "sound source position indexes") 1, . . . , K. For example, in a case where sound sources are a plurality of speakers who are having a conversation while being seated around a round table, M microphones are placed within a small area of approximately several square centimeters at the center of the round table, and only the azimuths of sound sources viewed from the center of the round table are focused as sound source positions, K azimuths $\Delta\phi$, $2\Delta\phi$, . . . , $K\Delta\phi$ ($\Delta\phi$=360°/K) obtained by equally dividing 0° to 360° into K can be used as the sound source position candidates. No limitation is intended by this example; in general, arbitrary predetermined K points can be designated as the sound source position candidates.

Also, the sound source position candidates may be sound source position candidates indicating diffusive noise. Diffusive noise does not arrive from one sound source position, but arrives from many sound source positions. By regarding such diffusive noise, too, as one sound source position candidate "arriving from many sound source positions", accurate estimation can be made even in a situation where diffusive noise exists.

The storage unit 13 stores probability distributions $q_{kf}$ of feature vectors z(t,f) for respective sound source position candidates k and respective frequency bins f (k=1, . . . , K, f=1, . . . , F).

The initializing unit, not shown, initializes sound source existence probabilities $\alpha_n(t)$ (n=1, . . . , N denotes a sound source index) which are existence probabilities of a signal from each sound source per frame, and sound source position probabilities $\beta_{kn}$ which are probabilities of arrival of a signal from each sound source position candidate per sound source (a probability distribution of sound source position indexes, which are indexes of sound source position candidates, per sound source) (step S4). For example, it is sufficient for the initializing unit to initialize these based on random numbers.

The estimation unit 10 models a sound source position occurrence probability matrix Q using a product of a sound source position probability matrix B and a sound source existence probability matrix A, and estimates at least one of the sound source position probability matrix B and the sound source existence probability matrix A based on the foregoing modeling.

The aforementioned sound source position occurrence probability matrix Q is composed of probabilities of arrival of a signal from each sound source position candidate per frame, which is a time section, with respect to a plurality of sound source position candidates.

The aforementioned sound source position probability matrix B is composed of probabilities of arrival of a signal from each sound source position candidate per sound source with respect to a plurality of sound sources.

The aforementioned sound source existence probability matrix A is composed of existence probabilities of a signal from each sound source per frame. The estimation unit 10 includes a posterior probability updating unit 14, a sound source existence probability updating unit 15, and a sound source position probability updating unit 16.

The posterior probability updating unit 14 receives the feature vectors z(t,f), the probability distributions $q_{kf}$, the sound source existence probabilities $\alpha_n(t)$, and the sound source position probabilities $\beta_{kn}$, and calculates and updates posterior probabilities $\gamma_{kn}(t,f)$ (step S5). Here, the posterior probabilities $\gamma_{kn}(t,f)$ are a joint distribution of sound source position indexes and sound source indexes in a situation where the feature vectors z(t,f) are given.

The aforementioned feature vectors z(t,f) are the output from the feature extraction unit 12.

The aforementioned probability distributions $q_{kf}$ are stored in the storage unit 13.

The aforementioned sound source existence probabilities $\alpha_n(t)$ are the output from the sound source existence probability updating unit 15. Note, as an exception, these are the sound source existence probabilities from the initializing unit at the time of first processing in the posterior probability updating unit 14.

The aforementioned sound source position probabilities $\beta_{kn}$ are the output from the sound source position probability updating unit 16. Note, as an exception, these are the sound source position probabilities from the initializing unit at the time of first processing in the posterior probability updating unit 14.

The sound source existence probability updating unit 15 receives the posterior probabilities $\gamma_{kn}(t,f)$ from the posterior probability updating unit 14, and updates the sound source existence probabilities $\alpha_n(t)$ (step S6).

The sound source position probability updating unit 16 receives the posterior probabilities $\gamma_{kn}(t,f)$ from the posterior probability updating unit 14, and updates the sound source position probabilities $\beta_{kn}$ (step S7).

The convergence determination unit, not shown, determines whether processing has converged (step S8). If the convergence determination unit determines that processing has not converged (step S8: No), processing is continued with a return to processing in the posterior probability updating unit 14 (step S5). On the other hand, if the convergence determination unit determines that processing has converged (step S8: Yes), the sound source existence probability updating unit 15 and the sound source position probability updating unit 16 output the sound source existence probabilities $\alpha_n(t)$ and the sound source position probabilities $\beta_{kn}$, respectively (step S9), and processing in the signal analysis device 1 ends.

Next, the details of processing of the first embodiment will be described. Processing in the frequency domain conversion unit 11 is as described earlier. The feature vectors z(t,f) extracted in the feature extraction unit 12 may be any feature vectors; in the present first embodiment, as examples thereof, feature vectors z(t,f) of expression (6) are used.

[Formula 6]

$$z(t,f)=\frac{y(t,f)}{\|y(t,f)\|_2} \tag{6}$$

Note that y(t,f) is expression (7), and $\|y(t,f)\|_2$ is expression (8) (a superscript T denotes a transpose).

[Formula 7]

$$y(t,f)=(y_1(t,f)\ \dots\ y_M(t,f))^T \tag{7}$$

[Formula 8]

$$\|y(t,f)\|_2=\sqrt{\sum_{m=1}^{M}|y_m(t,f)|^2} \tag{8}$$

Regarding the feature vectors of expression (6), see Reference Literature 1, "H. Sawada, S. Araki, and S. Makino, 'Underdetermined convolutive blind source separation via frequency bin-wise clustering and permutation alignment', IEEE Transactions on Audio, Speech, and Language Processing, vol. 19, no. 3, pp. 516-527, March 2011".

In the present first embodiment, probability distributions p(z(t,f)) of the feature vectors z(t,f) extracted in the feature extraction unit 12 are modeled using expression (9).

[Formula 9]

$$p(z(t,f))=\sum_{k=1}^{K}\pi_k(t)q_{kf}(z(t,f)) \tag{9}$$

Here, $\pi_k(t)$ denotes sound source position occurrence probabilities, which are a probability distribution of sound source position indexes per frame. As $\pi_k(t)$ are probabilities, $\pi_k(t)$ are considered to naturally satisfy the following expression (10).

[Formula 10]

$$\sum_{k=1}^{K}\pi_k(t)=1 \tag{10}$$

The model of expression (9) is based on the assumption that a feature vector z(t,f) at each time-frequency point (t,f) is generated based on the following generation processes.

1. A sound source position index k(t,f) indicating a sound source position of a sound source signal included in an observation signal y(t,f) at (t,f) is generated in accordance with a probability distribution of expression (11). That is to say, the probability that a sound source signal included in an observation signal y(t,f) at (t,f) arrives from the $k^{th}$ sound source position candidate is $\pi_k(t)$ (k=1, . . . , K).

[Formula 11]

$$P(k(t,f)=k)=\pi_k(t) \tag{11}$$

2. On the condition that a sound source position index indicating a sound source position of a sound source signal included in an observation signal y(t,f) at (t,f) is k(t,f)=k, a feature vector z(t,f) is generated in accordance with a conditional distribution of expression (12). That is to say, under the condition k(t,f)=k, a feature vector z(t,f) conforms to probability density $q_{kf}(z)$.

[Formula 12]

$$p(z(t,f)|k(t,f)=k)=q_{kf}(z(t,f)) \tag{12}$$

At this time, based on the rule of sum and the rule of product, a probability distribution of a feature vector z(t,f) is given by the following expression (13) to expression (15).

[Formula 13]

$$p(z(t,f)) = \sum_{k=1}^{K} p(z(t,f), k(t,f)=k) \ (\because \text{Rule of sum}) \quad (13)$$

$$= \sum_{k=1}^{K} P(k(t,f)=k)p(z(t,f) \mid k(t,f)=k) \left(\because \begin{matrix}\text{Rule of}\\ \text{product}\end{matrix}\right) \quad (14)$$

$$= \sum_{k=1}^{K} \pi_k(t) q_{kf}(z(t,f)) \ (\because (11)(12)) \quad (15)$$

In this way, expression (9) has been derived.

In the present first embodiment, it is considered that the probability distributions $q_{kf}$ of expression (12), which are the probability distributions of the feature vectors z(t,f) for respective sound source position candidates k and respective frequency bins f, are prepared and stored into the storage unit 13 in advance. For example, when feature vectors of expression (6) are used as the feature vectors z(t,f) and the probability distributions $q_{kf}$ are modeled using a complex Watson distribution of expression (16), it is sufficient for the storage unit 13 to store parameters $a_{kf}$ and $\kappa_{kf}$ for modeling pre-prepared $q_{kf}$ for respective sound source position candidates k and respective frequency bins f.

[Formula 14]

$$q_{kf}(z) = \mathcal{W}(z; a_{kf}, \kappa_{kf}) \quad (16)$$

Here, $a_{kf}$ is a parameter indicating the position of a peak (mode) of a probability distribution $q_{kf}$, and $\kappa_{kf}$ is a parameter indicating the steepness (concentration) of a peak of a probability distribution $q_{kf}$. These parameters may be prepared in advance based on information of microphone arrangement, or may be learnt in advance from data that has been actually measured. The details are disclosed in Reference Literature 2, "N. Ito, S. Araki, and T. Nakatani, 'Data-driven and physical model-based designs of probabilistic spatial dictionary for online meeting diarization and adaptive beamforming', in Proceedings of European Signal Processing Conference (EUSIPCO), pp. 1205-1209, August 2017". Also, when other feature vectors and probability distributions are used, probability distributions $q_{kf}$ can be prepared in a manner similar to the foregoing.

In the first embodiment, the attached letter f is used as in "$q_{kf}$". This is intended to enable handling of the case where the probability distributions $q_{kf}$ of the feature vectors z(t,f) are dependent on the frequency bins f as in the foregoing example; however, attention should be paid to the fact that, when $q_{k1} = \ldots = q_{kF}$, the case where the probability distributions $q_{kf}$ of the feature vectors z(t,f) are not dependent on the frequency bins f can also be handled.

It has been assumed that the sound source position occurrence probabilities $\pi_k(t)$ are dependent on the frames (that is to say, dependent on t) but are not dependent on the frequency bins (that is to say, not dependent on f). This is because which sound source position candidate has a high possibility of being the source of arrival of a sound source signal changes with time because, for example, a sound source (or sound sources) that is producing sound changes with time (e.g., in a conversation made by a plurality of people, a speaker who is making a speech changes with time).

In the present first embodiment, it is assumed that the sound source position occurrence probabilities $\pi_k(t)$ are expressed using the sound source existence probabilities $\alpha_n(t)$ and the sound source position probabilities $\beta_{kn}$ as in the following expression (17).

[Formula 15]

$$\pi_k(t) = \sum_{n=1}^{N} \alpha_n(t)\beta_{kn} \quad (17)$$

Here, the sound source existence probabilities $\alpha_n(t)$ and the sound source position probabilities $\beta_{kn}$ are probabilities, and are thus considered to satisfy the following two expressions (expression (18) and expression (19)).

[Formula 16]

$$\sum_{n=1}^{N} \alpha_n(t) = 1 \quad (18)$$

[Formula 17]

$$\sum_{k=1}^{K} \beta_{kn} = 1 \quad (19)$$

At this time, it can be confirmed that the sound source position occurrence probabilities $\pi_k(t)$ of expression (17) satisfy expression (10) as in the following expression (20) to expression (23).

[Formula 18]

$$\sum_{k=1}^{K} \pi_k(t) = \sum_{k=1}^{K}\sum_{n=1}^{N} \alpha_n(t)\beta_{kn} \quad (20)$$

$$= \sum_{n=1}^{N} \alpha_n(t) \sum_{k=1}^{K} \beta_{kn} \quad (21)$$

$$= \sum_{n=1}^{N} \alpha_n(t) \ (\because (19)) \quad (22)$$

$$= 1 \ (\because (18)) \quad (23)$$

The model of expression (17) is based on the assumption that a sound source position index k(t,f) at each time-frequency point (t,f) is generated based on the following generation processes.

1. A sound source index n(t,f) indicating a sound source signal included in an observation signal y(t,f) at (t,f) is generated in accordance with a probability distribution of expression (24).

[Formula 19]

$$P(n(t,f)=n) = \alpha_n(t) \quad (24)$$

2. On the condition that a sound source index indicating a sound source signal included in an observation signal y(t,f) at (t,f) is n(t,f)=n, a sound source position index k(t,f) at (t,f) is generated in accordance with a conditioned distribution of expression (25).

[Formula 20]

$$P(k(t,f)=k \mid n(t,f)=n) = \beta_{kn} \quad (25)$$

At this time, based on the rule of sum and the rule of product, a probability distribution of sound source position indexes k(t,f) is given by the following expression (26) to expression (29).

[Formula 21]

$$\pi_k(t) = P(k(t, f) = k) \ (\because (11)) \tag{26}$$

$$= \sum_{n=1}^{N} P(k(t, f) = k, n(t, f) = n) \ (\because \text{Rule of sum}) \tag{27}$$

$$= \sum_{n=1}^{N} P(n(t, f) = n) P(k(t, f) = k \mid n(t, f) = n) \left(\because \begin{matrix}\text{Rule of} \\ \text{product}\end{matrix}\right) \tag{28}$$

$$= \sum_{n=1}^{N} \alpha_n(t)\beta_{kn} \ (\because (24)(25)) \tag{29}$$

In this way, expression (17) has been derived.

Note, it has been assumed that the sound source existence probabilities $\alpha_n(t)$ are dependent on the frames (that is to say, dependent on t) but are not dependent on the frequency bins (that is to say, not dependent on f). This is because, although which sound source signal has a high probability of being existent changes with time because, for example, a sound source (or sound sources) that is producing sound changes with time, a frame in which a sound source is producing sound has a possibility that this sound source exists at any frequency. Also, it has been assumed that the sound source position probabilities $\beta_{kn}$ are not dependent on the frames and the frequency bins (that is to say, not dependent on t and f). This is based on the assumption that which sound source position candidate has a high possibility of being the source of arrival of each sound source signal is determined to some extent in accordance with the position of a sound source thereof, and does not fluctuate significantly.

Expression (17) can be represented in the form of a matrix as in the following expression (30).

[Formula 22]

$$Q=BA \tag{30}$$

Here, matrixes Q, B, and A are defined as in the following expression (31) to expression (33).

[Formula 23]

$$Q = \begin{pmatrix} \pi_1(1) & \pi_1(2) & \dots & \pi_1(T) \\ \pi_2(1) & \pi_2(2) & \dots & \pi_2(T) \\ \vdots & \vdots & \ddots & \vdots \\ \pi_K(1) & \pi_K(2) & \dots & \pi_K(T) \end{pmatrix} \tag{31}$$

[Formula 24]

$$B = \begin{pmatrix} \beta_{11} & \beta_{12} & \dots & \beta_{1N} \\ \beta_{21} & \beta_{22} & \dots & \beta_{2N} \\ \vdots & \vdots & \ddots & \vdots \\ \beta_{K1} & \beta_{K2} & \dots & \beta_{KN} \end{pmatrix} \tag{32}$$

[Formula 25]

$$A = \begin{pmatrix} \alpha_1(1) & \alpha_1(2) & \dots & \alpha_1(T) \\ \alpha_2(1) & \alpha_2(2) & \dots & \alpha_2(T) \\ \vdots & \vdots & \ddots & \vdots \\ \alpha_N(1) & \alpha_N(2) & \dots & \alpha_N(T) \end{pmatrix} \tag{33}$$

In practice, expression (17) is obtained from (k,t) elements in the both sides of expression (30). Q is a matrix composed of the sound source position occurrence probabilities $\pi_k(t)$, and is thus referred to as a sound source position occurrence probability matrix. B is a matrix composed of the sound source position probabilities $\beta_{kn}$, and is thus referred to as a sound source position probability matrix. A is a matrix composed of the sound source existence probabilities $\alpha_n(t)$, and is thus referred to as a sound source existence probability matrix.

In the present first embodiment, probability distributions of feature vectors z(t,f) are modeled by assigning expression (17) to expression (9), using the following expression (34).

[Formula 26]

$$p(z(t, f)) = \sum_{k=1}^{K} \left( \sum_{n=1}^{N} \alpha_n(t)\beta_{kn} \right) q_{kf}(z(t, f)) \tag{34}$$

In the present first embodiment, the sound source existence probabilities $\alpha_n(t)$ and the sound source position probabilities $\beta_{kn}$ are estimated (maximum likelihood estimation) based on maximization of a likelihood indicated by expression (35).

[Formula 27]

$$\prod_{t=1}^{T} \prod_{f=1}^{F} p(z(t, f)) \tag{35}$$

Maximum likelihood estimation can be realized based on an EM algorithm, by alternatingly repeating the E step and the M step a predetermined number of times. It is theoretically guaranteed that this iteration can monotonically increase a likelihood (expression (35)). That is to say, (a likelihood with respect to an estimated value of a parameter obtained through the $i^{th}$ iteration)≤(a likelihood with respect to an estimated value of a parameter obtained through the $(i+1)^{th}$ iteration).

In the E step, the posterior probabilities $\gamma_{kn}(t,f)$ of expression (36), which are a joint distribution of the sound source position indexes k(t,f) and the sound source indexes n(t,f) in a situation where the feature vectors z(t,f) are given, are updated based on the estimated values of the sound source existence probabilities $\alpha_n(t)$ and the sound source position probabilities $\beta_{kn}$ obtained in the M step (note, as an exception, the initial values of the estimated values of the sound source existence probabilities $\alpha_n(t)$ and the sound source position probabilities $\beta_{kn}$ at the time of the first iteration).

[Formula 28]

$$\gamma_{kn}=(t,f)=P(k(t,f)=k,n(t,f)=n|z(t,f)) \tag{36}$$

Here, the posterior probabilities $\gamma_{kn}(t,f)$ are probabilities, and thus naturally satisfy the following expression (37).

[Formula 29]

$$\sum_{k=1}^{K} \sum_{n=1}^{N} \gamma_{kn}(t, f) = 1 \tag{37}$$

In the E step, specifically, the posterior probabilities $\gamma_{kn}(t,f)$ are updated using the following expression (38). Note that processing of expression (38) is performed in the posterior probability updating unit 14.

[Formula 30]

$$\gamma_{kn}(t,f) \leftarrow \frac{\alpha_n(t)\beta_{kn}q_{kf}(z(t,f))}{\sum_{k=1}^{K}\sum_{v=1}^{N}\alpha_v(t)\beta_{kv}q_{kf}(z(t,f))} \tag{38}$$

In the M step, the estimated values of the sound source existence probabilities $\alpha_n(t)$ and the sound source position probabilities $\beta_{kn}$ are updated based on the posterior probabilities $\gamma_{kn}(t,f)$ as in the following expression (39) and expression (40). Processing of expression (39) is executed in the sound source existence probability updating unit 15, and processing of expression (40) is executed in the sound source position probability updating unit 16.

[Formula 31]

$$\alpha_n(t) \leftarrow \frac{1}{F}\sum_{f=1}^{F}\sum_{k=1}^{K}\gamma_{kn}(t,f) \tag{39}$$

[Formula 32]

$$\beta_{kn} \leftarrow \frac{\sum_{t=1}^{T}\sum_{f=1}^{F}\gamma_{kn}(t,f)}{\sum_{\kappa=1}^{K}\sum_{t=1}^{T}\sum_{f=1}^{F}\gamma_{\kappa n}(t,f)} \tag{40}$$

Note that the maximization of the likelihood (expression (35)) is not limited to being performed using the EM algorithm, and may be performed using other optimization methods (e.g., a gradient method).

Also, processing of expression (38) is not indispensable. For example, when the gradient method is used instead of the EM algorithm, processing of expression (38) is unnecessary.

Furthermore, when the sound source existence probabilities $\alpha_n(t)$ are known, the sound source existence probabilities $\alpha_n(t)$ may be fixed and only the sound source position probabilities $\beta_{kn}$ may be estimated, rather than estimating both of the sound source existence probabilities $\alpha_n(t)$ and the sound source position probabilities $\beta_{kn}$. For example, it is sufficient to fix the sound source existence probabilities $\alpha_n(t)$, and alternatingly repeat updating of the posterior probabilities $\gamma_{kn}(t,f)$ using expression (38) and updating of the sound source position probabilities $\beta_{kn}$ using expression (40).

Furthermore, when the sound source position probabilities $\beta_{kn}$ are known, the sound source position probabilities $\beta_{kn}$ may be fixed and only the sound source existence probabilities $\alpha_n(t)$ may be estimated, rather than estimating both of the sound source existence probabilities $\alpha_n(t)$ and the sound source position probabilities $\beta_{kn}$. For example, it is sufficient to fix the sound source position probabilities $\beta_{kn}$ and alternatingly repeat updating of the posterior probabilities $\gamma_{kn}(t,f)$ using expression (38) and updating of the sound source existence probabilities $\alpha_n(t)$ using expression (39).

A description is now given of derivation of expression (38), expression (39), and expression (40) representing the update rules in the aforementioned EM algorithm. In the E step, posterior probabilities of latent variables are updated based on the estimated values of the parameters obtained in the M step (note, as an exception, the initial values of the estimated values of the parameters in the first iteration). The latent variables in the present first embodiment are considered to be the sound source position indexes k(t,f) and the sound source indexes n(t,f). Therefore, the posterior probabilities $\gamma_{kn}(t,f)$ of the latent variables are as in expression (41).

[Formula 33]

$$\gamma_{kn}(t,f)=P(k(t,f)=k,n(t,f)=n|z(t,f)) \tag{41}$$

This can be calculated as in the following expression (42) to expression (44).

[Formula 34]

$$\gamma_{kn}(t,f) = \frac{P(k(t,f)=k,n(t,f)=n)p(z(t,f)\mid k(t,f)=k,n(t,f)=n)}{\sum_{\kappa=1}^{K}\sum_{v=1}^{N}P(k(t,f)=\kappa,n(t,f)=v)p(z(t,f)\mid k(t,f)=\kappa,n(t,f)=v)} \tag{42}$$

$$= \frac{P(n(t,f)=n)P(k(t,f)=k\mid n(t,f)=n)p(z(t,f)\mid k(t,f)=k)}{\sum_{\kappa=1}^{K}\sum_{v=1}^{N}P(n(t,f)=v)P(k(t,f)=\kappa\mid n(t,f)=v)p(z(t,f)\mid k(t,f)=\kappa)} \tag{43}$$

( ∵ Bayes's theorem)

$$= \frac{\alpha_n(t)\beta_{kn}q_{kf}(z(t,f))}{\sum_{\kappa=1}^{K}\sum_{v=1}^{N}\alpha_v(t)\beta_{\kappa v}q_{\kappa f}(z(t,f))} \tag{44}$$

In this way, expression (38) representing the update rule of the E step has been derived.

In the M step, the estimated values of the parameters are updated based on the posterior probabilities of the latent variables calculated in the E step. The update rule at this time is obtained by, with respect to a logarithm of a joint distribution of observation variables and latent variables, maximizing a Q function obtained by calculating expected values related to the posterior probabilities of the latent variables calculated in the E step. In the case of the present first embodiment, as the observation variables are feature vectors z(t,f) and the latent variables are the sound source position indexes k(t,f) and the sound source indexes n(t,f), the Q function is as indicated by the following expression (45) to expression (48).

[Formula 35]

$$Q = \sum_{t=1}^{T}\sum_{f=1}^{F}\left(\sum_{k=1}^{K}\sum_{n=1}^{N}\underbrace{\gamma_{kn}(t,f)}_{\text{Posterior probabilities of latent variables}} \times \underbrace{\ln p(z(t,f),k(t,f)=k,n(t,f)=n)}_{\text{Logarithm of joint distribution of observation variables and latent variables}}\right) \tag{45}$$

$$= \sum_{t=1}^{T}\sum_{f=1}^{F}\sum_{k=1}^{K}\sum_{n=1}^{N}\gamma_{kn}(t,f)\ln[P(n(t,f)=n)P(k(t,f)=k|n(t,f)=n)p(z(t,f)|k(t,f)=k)] \tag{46}$$

$$= \sum_{t=1}^{T}\sum_{f=1}^{F}\sum_{k=1}^{K}\sum_{n=1}^{N}\gamma_{kn}(t,f)\ln[\alpha_n(t)\beta_{kn}q_{kf}(z(t,f))] \tag{47}$$

$$= \sum_{t=1}^{T}\sum_{f=1}^{N}\left(\sum_{k=1}^{F}\sum_{n=1}^{N}\gamma_{kn}(t,f)\right)\ln\alpha_n(t) + \sum_{k=1}^{K}\sum_{n=1}^{N}\left(\sum_{t=1}^{T}\sum_{f=1}^{F}\gamma_{kn}(t,f)\right)\ln\beta_{kn} + C \tag{48}$$

Here, C denotes a constant that is not dependent on the sound source existence probabilities $\alpha_n(t)$ and the sound source position probabilities $\beta_{kn}$. The estimated values of the sound source existence probabilities $\alpha_n(t)$ and the sound source position probabilities $\beta_{kn}$ that maximize this Q function are obtained by applying the method of Lagrange undetermined multipliers, with attention to expression (18) and expression (19) representing constraint conditions. Although only the sound source existence probabilities $\alpha_n(t)$ will be described below, the same goes for the sound source position probabilities $\beta_{kn}$. Below is expression (49) in which a Lagrange undetermined multiplier is represented by $\lambda$.

[Formula 36]

$$\sum_{n=1}^{N}\left(\sum_{f=1}^{F}\sum_{k=1}^{K}\gamma_{kn}(t,f)\right)\ln\alpha_n(t) - \lambda\left(\sum_{n=1}^{N}\alpha_n(t) - 1\right) \tag{49}$$

Given 0 as the result of partially differentiating expression (49) with respect to $\alpha_n(t)$, expression (50) is obtained.

[Formula 37]

$$\left(\sum_{f=1}^{F}\sum_{k=1}^{K}\gamma_{kn}(t,f)\right)\frac{1}{\alpha_n(t)} - \lambda = 0 \tag{50}$$

Solving this with respect to $\alpha_n(t)$ yields expression (51).

[Formula 38]

$$\alpha_n(t) = \frac{1}{\lambda}\sum_{f=1}^{F}\sum_{k=1}^{K}\gamma_{kn}(t,f) \tag{51}$$

While expression (51) includes the Lagrange undetermined multiplier $\lambda$, the value of $\lambda$ can be set by assigning expression (51) to expression (18) representing a constraint condition (see expression (52) and expression (53)).

[Formula 39]

$$1 = \sum_{n=1}^{N}\frac{1}{\lambda}\sum_{f=1}^{F}\sum_{k=1}^{K}\gamma_{kn}(t,f) \tag{52}$$

$$= \frac{F}{\lambda}\ (\because (37)) \tag{53}$$

Therefore, $\lambda$=F. In this way, expression (39) has been derived.

Effects of First Embodiment

In the foregoing manner, in the first embodiment, the sound source position occurrence probability matrix Q is modeled using the product of the sound source position probability matrix B and the sound source existence probability matrix A. Therefore, in the present first embodiment, at least one of the sound source position probability matrix B and the sound source existence probability matrix A can be optimally estimated based on the foregoing modeling.

The aforementioned sound source position occurrence probability matrix Q is composed of probabilities of arrival of a signal from each sound source position candidate per frame, which is a time section, with respect to a plurality of sound source position candidates.

The aforementioned sound source position probability matrix B is composed of probabilities of arrival of a signal from each sound source position candidate per sound source with respect to a plurality of sound sources.

The aforementioned sound source existence probability matrix A is composed of existence probabilities of a signal from each sound source per frame.

As will be described later, estimation of the sound source existence probability matrix is equivalent to diarization. Therefore, diarization can be optimally performed with the configuration that estimates the sound source position probability matrix and the sound source existence probability matrix and the configuration that estimates only the sound source existence probability matrix, which have been presented in the present first embodiment. Also, as will be described later, estimation of the sound source position probability matrix is equivalent to sound source localization. Therefore, sound source localization can be appropriately executed with the configuration that estimates the sound source position probability matrix and the sound source existence probability matrix and the configuration that estimates only the sound source position probability matrix, which have been presented in the present first embodiment.

First Modification Example of First Embodiment

A first modification example of the first embodiment will be described using an example in which diarization is performed using the sound source existence probabilities $\alpha_n(t)$ obtained in the first embodiment.

Figure 3:
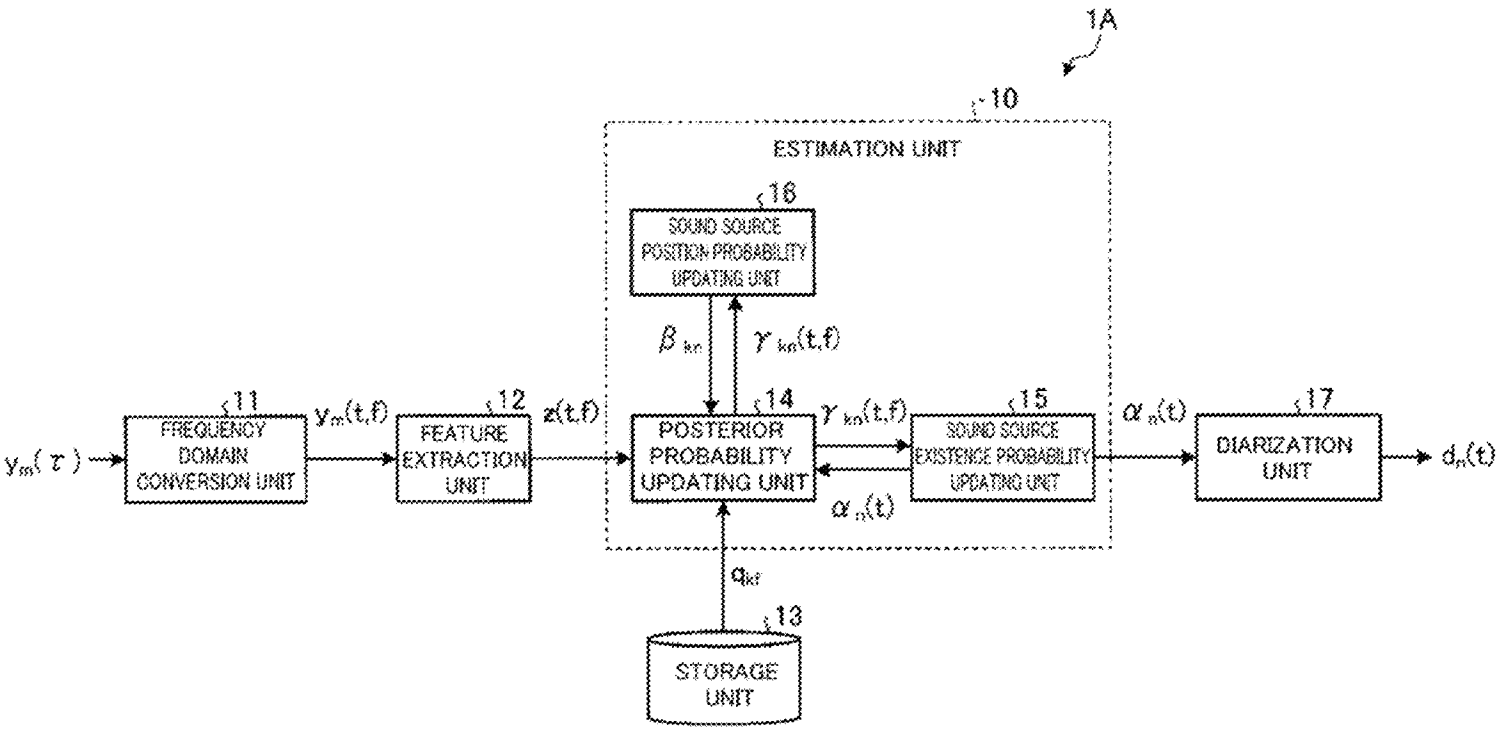
FIG. 3 is a figure showing one example of a configuration of a signal analysis device according to a first modification example of the first embodiment.

FIG. 3 is a figure showing one example of a configuration of a signal analysis device according to the first modification example of the first embodiment. As shown in FIG. 3, a signal analysis device 1A according to the first modification example of the first embodiment further includes a diarization unit 17 that performs diarization in comparison to the signal analysis device 1 shown in FIG. 1.

Here, diarization is a technique that, in a situation where a plurality of people are having a conversation, determines whether each speaker is speaking at each time from observation signals obtained by microphones. When the first embodiment is applied in such a situation, a sound source existence probability $\alpha_n(t)$ can be regarded as the probability that each speaker is speaking at each time. In view of this, the diarization unit 17 determines whether each speaker is speaking, that is to say, performs diarization in each frame by making a determination as in expression (54) with c serving as a predetermined threshold (e.g., c=0.5), and outputs a diarization result $d_n(t)$. For example, it is sufficient that $d_n(t)$ be 1 when it is determined that a speaker n is speaking in a frame t, and 0 when it is determined otherwise.

[Formula 40]

$$\begin{cases} \alpha_n(t) > c \Longrightarrow \text{Determine that speaker } n \text{ is speaking in frame } t \\ a_n(t) \le c \Longrightarrow \text{Determine that speaker } n \text{ is not speaking in frame } t \end{cases} \quad (54)$$

Note that when a sound source signal is composed of both of a speech signal and noise, it is permissible to adopt a configuration that uses only $\alpha_n(t)$ with respect to n corresponding to the sound signal. For example, when n=1, . . . , N−1 corresponds to speech signals and n=N corresponds to noise, whether speakers 1 to N−1 are speaking in each frame can be determined by applying expression (54) to $\alpha_n(t)$ ($1 \le n \le N-1$).

Note that expression (54) is an example. Therefore, in the top formula of expression (54), "$\alpha_n$>(t)>c" may be replaced with "$\alpha_n(t) \ge c$". That is to say, the diarization unit 17 may determine that "a speech is being made (a signal from a sound source exists)" when the sound source existence probability $\alpha_n(t)$ is equal to or larger than the predetermined threshold, instead of determining that "a speech is being made (a signal from a sound source exists)" when the sound source existence probability $\alpha_n(t)$ is larger than the predetermined threshold. Also, in the bottom formula of expression (54), "$\alpha_n \le (t) \le c$" may be replaced with "$\alpha_n$<(t)<c". That is to say, the diarization unit 17 may determine that "a speech is not being made (a signal from a sound source does not exist)" when the sound source existence probability $\alpha_n(t)$ is smaller than the predetermined threshold, instead of determining that "a speech is not being made (a signal from a sound source does not exist)" when the sound source existence probability $\alpha_n(t)$ is equal to or smaller than the predetermined threshold. Furthermore, the diarization unit 17 may only determine that "a speech is being made (a signal from a sound source exists)", may only determine that "a speech is not being made (a signal from a sound source does not exist)", or may determine both.

As in this signal analysis device 1A, it is permissible to further include the diarization unit 17 and perform diarization, the diarization unit 17 determining that, with respect to at least one frame of at least one sound source, a signal from this sound source exists in this frame when an existence probability of the signal from this sound source in this frame included in the sound source existence probability matrix A is larger than the predetermined threshold or is equal to or larger than the predetermined threshold, and/or determining that, with respect to at least one frame of at least one sound source, a signal from this sound source does not exist in this frame when an existence probability of the signal from this sound source in this frame included in the sound source existence probability matrix A estimated by the estimation unit 10 is smaller than the predetermined threshold or is equal to or smaller than the predetermined threshold.

Second Modification Example of First Embodiment

A second modification example of the first embodiment will be described using an example in which sound source localization is performed using the sound source position probabilities $\beta_{kn}$ obtained in the first embodiment.

Figure 4:
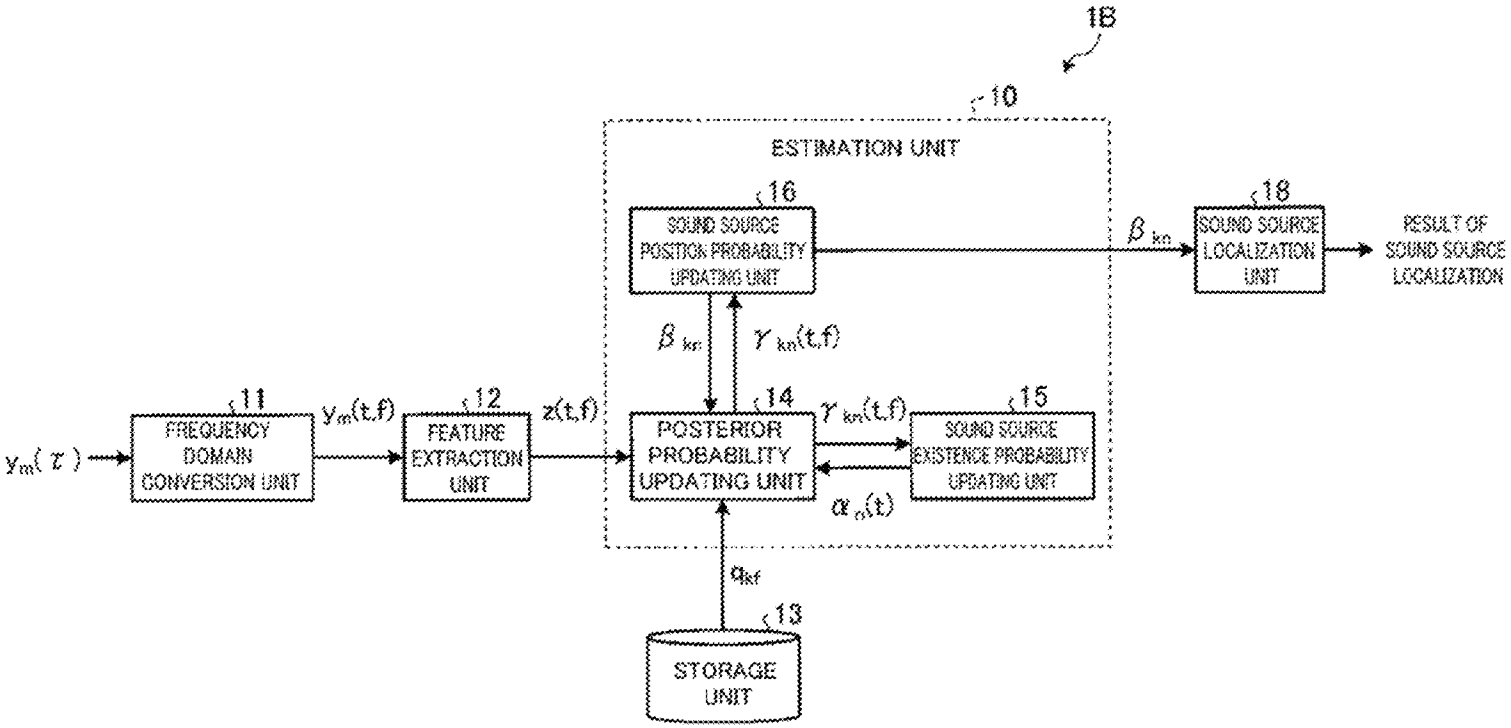
FIG. 4 is a figure showing one example of a configuration of a signal analysis device according to the second modification example of the first embodiment.

FIG. 4 is a figure showing one example of a configuration of a signal analysis device according to the second modification example of the first embodiment. As shown in FIG. 4, a signal analysis device 1B according to the second modification example of the first embodiment further includes a sound source localization unit 18 that performs sound source localization in comparison to the signal analysis device 1 shown in FIG. 1.

Here, sound source localization is a technique to estimate coordinates of each sound source (there may be a plurality of sound sources) from observation signals obtained by microphones. Especially, there is a case where all of Cartesian coordinates $(\xi\eta\zeta)^T$ ($\xi$, $\eta$, and $\zeta$ are x, y, and z coordinates, respectively) or spherical coordinates $(\rho\theta\phi)^T$ ($\rho$, $\theta$, and $\phi$ are a radial distance, a zenith angle, and an azimuth angle, respectively) of each sound source are estimated, as well as a case where only a part of these coordinates, for example, only the azimuth angle $\phi$ is estimated (sound source localization of this case is also referred to as arrival direction estimation).

In the second modification example of the present first embodiment, it is assumed that the coordinates of each sound source position candidate (Cartesian coordinates, spherical coordinates, or a part of these coordinates) are known.

Also, a sound source position probability $\beta_{kn}$ obtained in the first embodiment can be regarded as the probability that the position of each sound source is each sound source position candidate. In view of this, the sound source localization unit 18 estimates and outputs the coordinates of each sound source by performing processing as follows.

1. Fix n, and obtain a value kn of k that maximizes $\beta_{kn}$.
2. Use the coordinates of a sound source position candidate corresponding to the value kn as estimated values of the coordinates of the $n^{th}$ sound source.
3. Perform aforementioned 1 and 2 with respect to each n.

Third Modification Example of First Embodiment

A third modification example of the first embodiment will be described using an example in which masks indicating which sound source exists at each time-frequency point are obtained using the sound source existence probabilities $\alpha_n(t)$ and the sound source position probabilities $\beta_{kn}$ obtained in the first embodiment.

Figure 5:
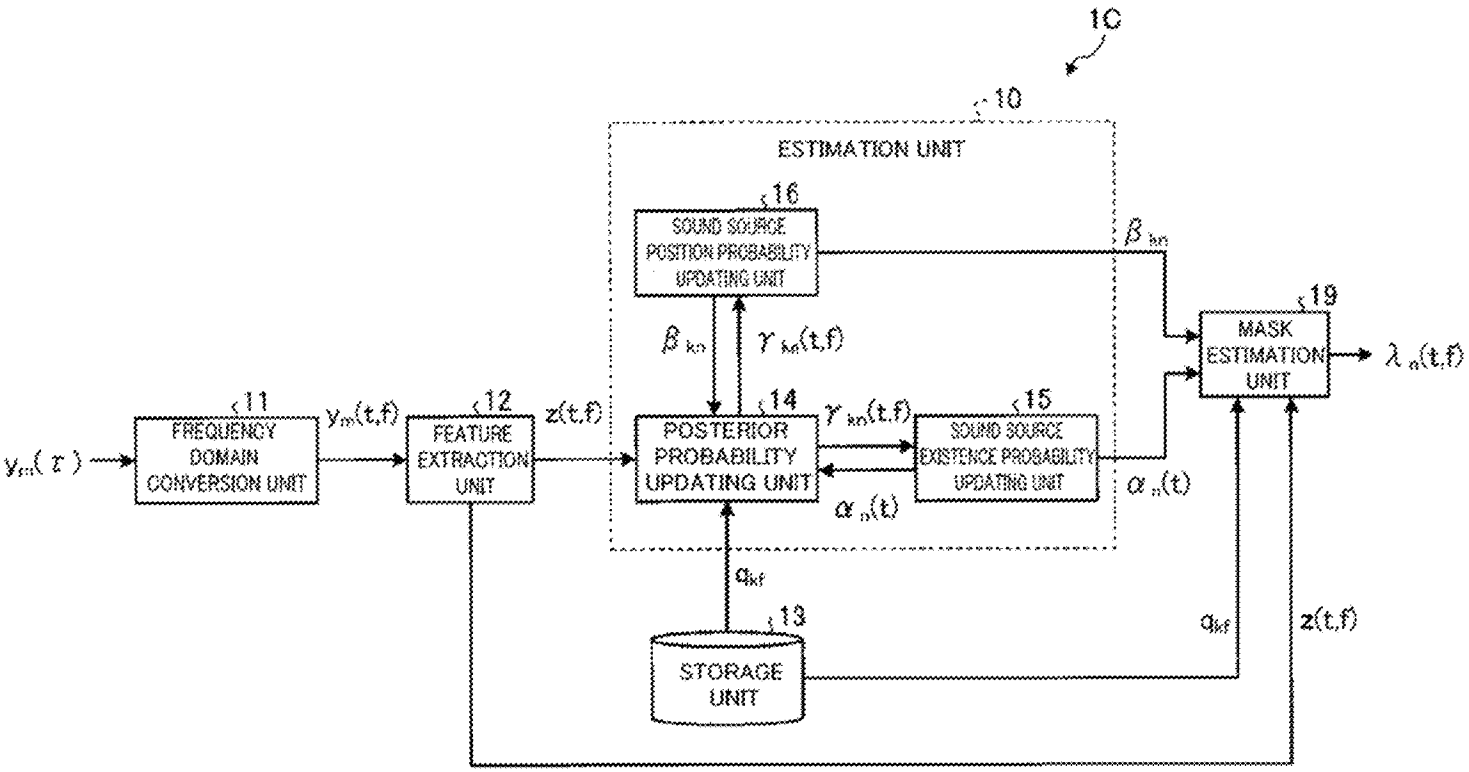
FIG. 5 is a figure showing one example of a configuration of a signal analysis device according to the third modification example of the first embodiment.

FIG. 5 is a figure showing one example of a configuration of a signal analysis device according to the third modification example of the first embodiment. As shown in FIG. 5, a signal analysis device 1C according to the third modification example of the first embodiment further includes a mask estimation unit 19 that estimates masks using the sound source existence probabilities $\alpha_n(t)$ and the sound source position probabilities $\beta_{kn}$ in comparison to the signal analysis device 1 shown in FIG. 1. The mask estimation unit 19 estimates masks indicating which sound source exists at each time-frequency point using the sound source existence probabilities $\alpha_n(t)$, the sound source position probabilities $\beta_{kn}$, the feature vectors z(t,f), and the probability distributions $q_{kf}$. • The aforementioned sound source existence probability $\alpha_n(t)$ is the existence probability of a signal from each sound source per frame included in the sound source existence probability matrix A.

The aforementioned sound source position probability $\beta_{kn}$ is the probability of arrival of a signal from each sound source position candidate per sound source included in the sound source position probability matrix B.

The aforementioned feature vector z(t,f) is the output from a feature extraction unit 12.

The aforementioned probability distribution $q_{kf}$ is stored in a storage unit 13.

Using the sound source existence probability $\alpha_n(t)$, the sound source position probability $\beta_{kn}$, the feature vector z(t,f), and the probability distribution $q_{kf}$, the mask estimation unit 19 first calculates a posterior probability $\gamma_{kn}(t,f)$, which is a joint distribution of a sound source position index k(t,f) and a sound source index n(t,f) at each time-frequency point in a situation where the feature vector z(t,f) has been observed, using the following expression (55). Note that when the EM algorithm is used, the posterior probability $\gamma_{kn}(t,f)$ of expression (38) updated in the E step may be used as is.

[Formula 41]

$$\gamma_{kn}(t,f) \leftarrow \frac{\alpha_n(t)\beta_{kn}q_{kf}(z(t,f))}{\sum_{\kappa=1}^{K}\sum_{\nu=1}^{N}\alpha_\nu(t)\beta_{\kappa\nu}q_{\kappa f}(z(t,f))} \tag{55}$$

Next, the mask estimation unit 19 calculates a mask $\lambda_n(t,f)$ (expression (56)), which is a conditioned probability of the sound source index n(t,f) in the situation where the feature vector z(t,f) has been observed.

[Formula 42]

$$\lambda_n(t,f)=P(n(t,f)=n|z(t,f)) \tag{56}$$

Specifically, the mask estimation unit 19 can calculate the mask $\lambda_n(t,f)$ using the posterior probability $\gamma_{kn}(t,f)$ based on the following expression (57) and expression (58).

[Formula 43]

$$\lambda_n(t,f) = \sum_{k=1}^{K} P(k(t,f)=k, n(t,f)=n \mid z(t,f)) \ (\because \text{Rule of sum}) \tag{57}$$

$$= \sum_{k=1}^{K} \gamma_{kn}(t,f) \tag{58}$$

Based on the foregoing expressions and expression (37), $\lambda_n(t,f)$ satisfies the following expression (59).

[Formula 44]

$$\sum_{n=1}^{N} \lambda_n(t,f) = 1 \tag{59}$$

The mask, once obtained, can be used in sound source separation, noise removal, sound source localization, and so forth. The following describes an example of application to sound source separation.

The mask $\lambda_n(t,f)$ takes a value close to 1 when a sound source signal n exists at a time-frequency point (t,f), and takes a value close to 0 otherwise. Therefore, for example, by applying a mask $\lambda_n(t,f)$ corresponding to the sound source signal n to an observation signal $y_1(t,f)$ obtained by the first microphone, components at the time-frequency point (t,f) at which the sound source signal n exists are stored, and components at time-frequency points (t,f) at which the sound source signal n does not exist are suppressed; therefore, a separation signal $\hat{s}_n(t,f)$ corresponding to the sound source signal n is obtained as in expression (60).

[Formula 45]

$$\hat{s}_n(t,f)=\lambda_n(t,f)y_1(t,f) \tag{60}$$

Then, by applying this to each sound source signal n, sound source separation can be realized. Note that although the above has described an example that uses the observation signal $y_1(t,f)$ obtained by the first microphone, no limitation is intended by this, and an observation signal obtained by an arbitrary microphone can be used.

Fourth Modification Example of First Embodiment

Although the first embodiment and the first to third modification examples of the first embodiment have been described in relation to batch processing in which processing is performed collectively after observation signal vectors y(t,f) of all frames have been obtained, it is permissible to perform online processing in which processing is performed in sequence each time observation signal vectors y(t,f) of each frame are obtained. The fourth modification example of the first embodiment will be described in relation to this online processing.

Among expression (38), expression (39), and expression (40) representing processing of the aforementioned EM algorithm, expression (38) and expression (39) can be calculated on a per-frame basis, but expression (40) includes a sum related to t and thus cannot be calculated on a per-frame basis as is. In order to enable calculation thereof on a per-frame basis, first, attention should be paid to the fact that expression (40) can be rewritten as the following expression (61).

[Formula 46]

$$\beta_{kn} \leftarrow \frac{\overline{\gamma}_{kn}}{\sum_{\kappa=1}^{K}\overline{\gamma}_{\kappa n}} \tag{61}$$

Here, a sign represented by $\gamma_{kn}$ with "-" written thereabove, which is presented in expression (62), is an average of posterior probabilities $\gamma_{kn}(t,f)$ with respect to t and f.

[Formula 47]

$$\overline{\gamma}_{kn} = \frac{1}{TF}\sum_{t=1}^{T}\sum_{f=1}^{F}\gamma_{kn}(t,f) \tag{62}$$

In order to enable calculation of $\beta_{kn}$ on a per-frame basis, the average indicated by the sign represented by $\gamma_{kn}$ with "-" written thereabove in expression (61) is replaced with a moving average $\sim\gamma_{kn}$ (expression (63)). Here, $\beta_{kn}(t)$ has the same meaning as $\beta_{kn}$, but explicitly denotes a value that has been updated with respect to a frame t.

[Formula 48]

$$\beta_{kn}(t) \leftarrow \frac{\tilde{\gamma}_{kn}(t)}{\sum_{\kappa=1}^{K} \tilde{\gamma}_{\kappa n}(t)} \tag{63}$$

Here, the moving average $\sim\gamma_{kn}$ (t) can be updated on a per-frame basis using the following expression (64). Note that δ denotes a forgetting factor.

[Formula 49]

$$\tilde{\gamma}_{kn}(t) \leftarrow (1-\delta)\tilde{\gamma}_{kn}(t-1) + \delta\frac{1}{F}\sum_{f=1}^{F}\gamma_{kn}(t, f) \tag{64}$$

The flow of processing in the signal analysis device 1 according to the fourth modification example of the present first embodiment is as follows. With respect to each frame t, the posterior probability updating unit 14 updates the posterior probabilities $\gamma_{kn}(t,f)$ using expression (38), the sound source existence probability updating unit 15 updates the sound source existence probabilities $\alpha_n(t)$ using expression (39), and the sound source position probability updating unit 16 updates the moving average $\gamma_{kn}(t)$ using expression (64) and the sound source position probabilities $\beta_{kn}(t)$ using expression (63).

Fifth Modification Example of First Embodiment

The first embodiment has been described in relation to an example in which the sound source position probability matrix and the sound source existence probability matrix are estimated by applying, to feature vectors z(t,f), a mixture distribution that uses the sound source position occurrence probability matrix represented by the product of the sound source position probability matrix and the sound source existence probability matrix as a mixture weight. No limitation is intended by this, and the first embodiment may adopt a configuration that estimates the sound source position probability matrix and the sound source existence probability matrix by first obtaining the sound source position occurrence probability matrix using a conventional technique, and then factorizing this into the product of the sound source position probability matrix and the sound source existence probability matrix. The fifth modification example of the present first embodiment will be described in relation to such a configuration example.

The signal analysis device according to the fifth modification example of the first embodiment obtains the sound source position probabilities $\beta_{kn}$ and the sound source existence probabilities $\alpha_n(t)$ by estimating the sound source position occurrence probabilities $\pi_k(t)$ using a conventional technique, and factorizing the sound source position occurrence probability matrix Q composed of the sound source position occurrence probabilities $\pi_k(t)$ into the product of the sound source position probability matrix B composed of the sound source position probabilities $\beta_{kn}$ and the sound source existence probability matrix A composed of the sound source existence probabilities $\alpha_n(t)$ as in expression (65).

[Formula 50]

$$Q=BA \tag{65}$$

This can be performed by estimating the sound source position probability matrix B and the sound source existence probability matrix A so that the product BA of the sound source position probability matrix B and the sound source existence probability matrix A approximates the sound source position occurrence probability matrix Q.

The foregoing estimation can be performed using an existing technique, such as NMF (nonnegative matrix factorization). NMF is disclosed in Reference Literature 3, "Hirokazu Kameoka, 'Non-negative Matrix Factorization', the Journal of the Society of Instrument and Control Engineers, vol. 51, no. 9, 2012", Reference Literature 4, "Hiroshi Sawada, 'Nonnegative Matrix Factorization and Its Applications to Data/Signal Analysis', the Journal of Institute of Electronics, Information and Communication Engineers, vol. 95, no. 9, pp. 829-833, 2012", and the like.

Sixth Modification Example of First Embodiment

The present first embodiment may be applied not only to sound signals, but also to other signals (electroencephalogram, magnetoencephalogram, wireless signals, and the like). That is, observation signals in the present embodiment are not limited to observation signals obtained by a plurality of microphones (a microphone array), and may also be observation signals composed of signals that have been obtained by another sensor array (a plurality of sensors) of an electroencephalography device, a magnetoencephalography device, an antenna array, and the like, and that are generated from spatial positions in chronological order.

[System Configuration, Etc.]

Also, the constituent elements of devices shown are functional concepts, and need not necessarily be physically configured as shown in the figures. That is to say, a specific form of separation and integration of devices is not limited to those shown in the figures, and all or a part of devices can be configured in a functionally or physically separated or integrated manner, in arbitrary units, in accordance with various types of loads, statuses of use, and the like. Furthermore, all or an arbitrary part of processing functions implemented in devices can be realized by a CPU and a program that is analyzed and executed by this CPU, or realized as hardware using a wired logic.

Also, among processes that have been described in the present embodiment, processes that have been described as being performed automatically can also be entirely or partially performed manually, or processes that have been described as being performed manually can also be entirely or partially performed automatically using a known method. In addition, processing procedures, control procedures, specific terms, and information including various types of data and parameters presented in the foregoing text and figures can be changed arbitrarily, unless specifically stated otherwise. That is to say, the processes that have been described in relation to the foregoing learning methods and speech recognition methods are not limited to being executed chronologically in the stated order, and may be executed in parallel or individually in accordance with the processing capacity of a device that executes the processes or as necessary.

[Program]

Figure 6:
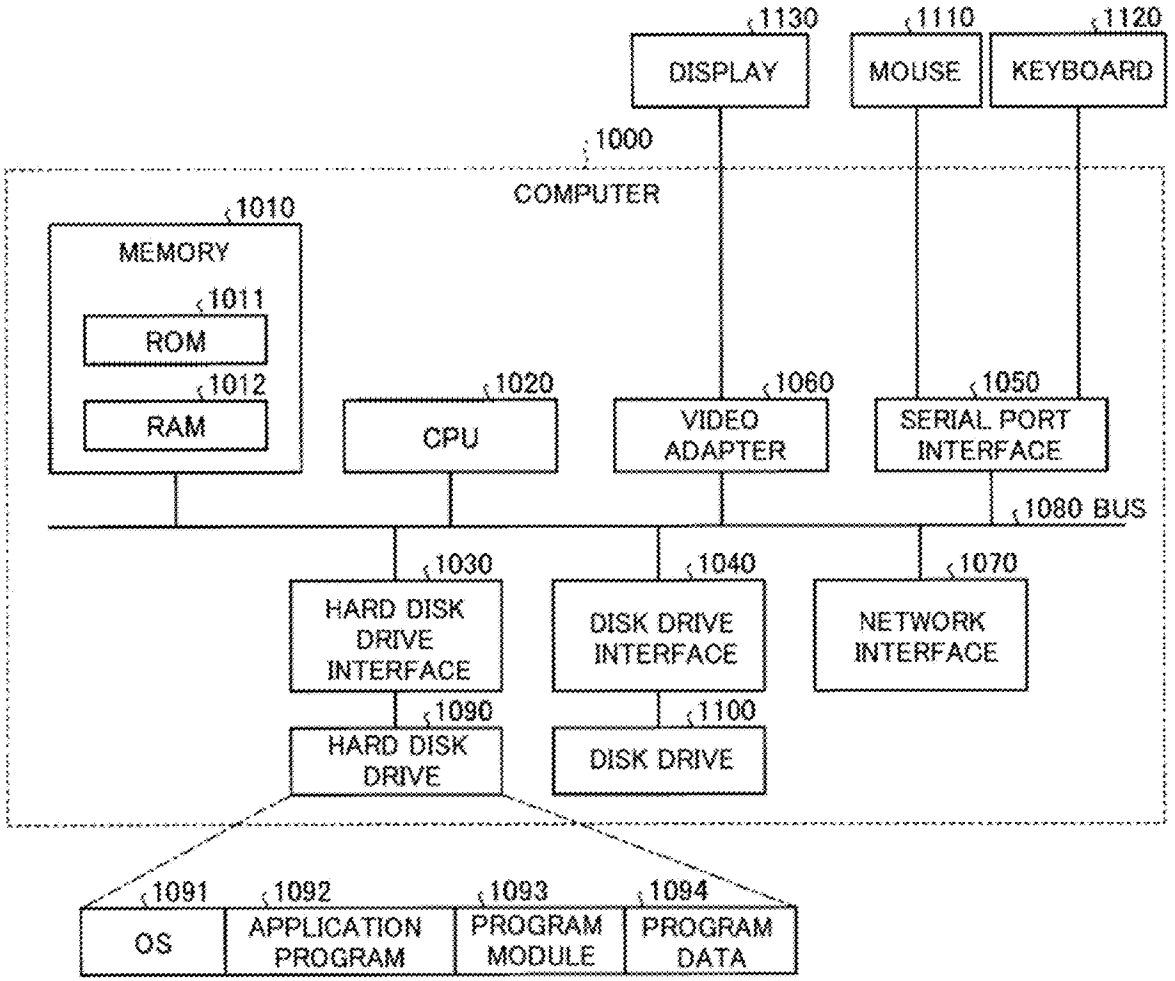
FIG. 6 is a figure showing one example of a computer with which a signal analysis device is realized through the execution of a program.
Figure 7:
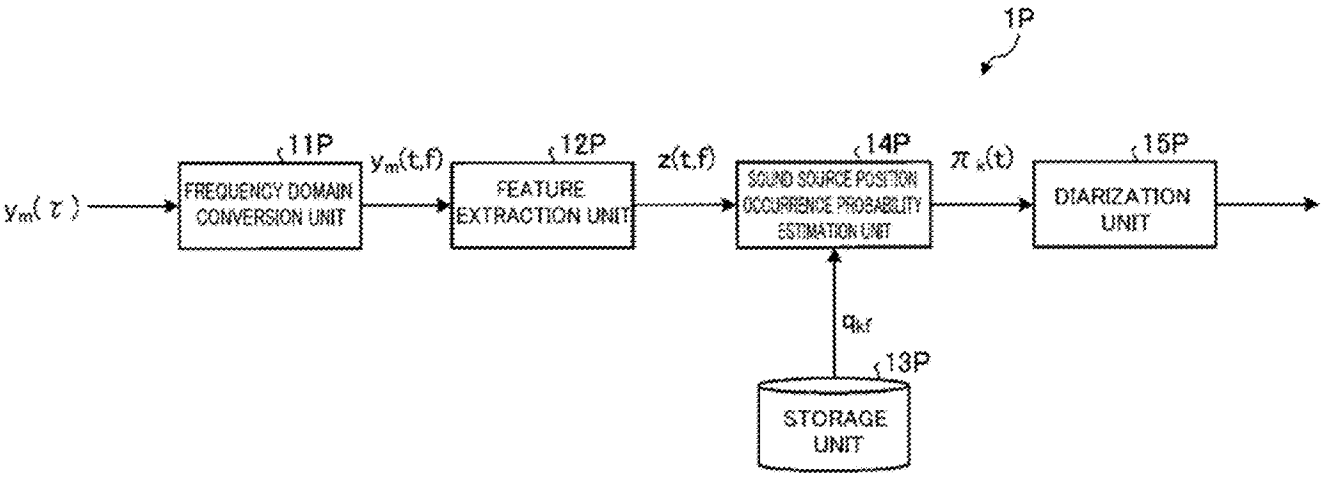
FIG. 7 is a figure showing a configuration of a conventional diarization device.
Figure 8:
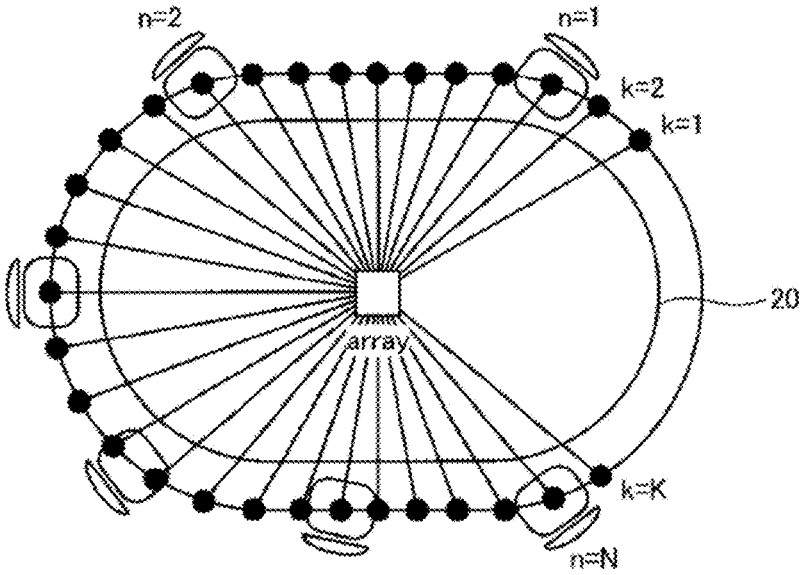
FIG. 8 is a figure illustrating position candidates of speakers in a case where the use in a speech conference is assumed.

FIG. 6 is a figure showing one example of a computer with which the signal analysis devices 1, 1A, 1B, and 1C are realized through the execution of a program. A computer 1000 includes, for example, a memory 1010 and a CPU 1020. The computer 1000 also includes a hard disk drive interface 1030, a disk drive interface 1040, a serial port interface 1050, a video adapter 1060, and a network interface 1070. These components are connected by a bus 1080.

The memory 1010 includes a ROM 1011 and a RAM 1012. The ROM 1011 stores, for example, a boot program such as a BIOS (Basic Input Output System). The hard disk drive interface 1030 is connected to a hard disk drive 1090. The disk drive interface 1040 is connected to a disk drive 1100. For example, a removable storage medium such as a magnetic disk and an optical disc is inserted into the disk drive 1100. The serial port interface 1050 is connected to, for example, a mouse 1110 and a keyboard 1120. The video adapter 1060 is connected to, for example, a display 1130.

The hard disk drive 1090 stores, for example, an OS (Operating System) 1091, an application program 1092, a program module 1093, and program data 1094. That is to say, a program that defines the processes of the signal analysis devices 1A, 1B, and 1C is implemented as the program module 1093 in which codes that can be executed by the computer 1000 are written. The program module 1093 is stored in, for example, the hard disk drive 1090. For example, the program module 1093 for executing processes that are similar to the functional configurations of the signal analysis devices 1, 1A, 1B, and 1C is stored in the hard disk drive 1090. Note that the hard disk drive 1090 may be replaced with an SSD (Solid State Drive).

Also, setting data used in the processes of the above-described embodiment is stored as the program data 1094 in, for example, the memory 1010 and the hard disk drive 1090. Then, the CPU 1020 reads out the program module 1093 and the program data 1094 stored in the memory 1010 and the hard disk drive 1090 into the RAM 1012 and executes the same as necessary.

Note that the program module 1093 and the program data 1094 are not limited to being stored in the hard disk drive 1090, and may be, for example, stored in a removable storage medium and read out by the CPU 1020 via the disk drive 1100 and the like. Alternatively, the program module 1093 and the program data 1094 may be stored in another computer connected via a network (a LAN (Local Area Network), a WAN (Wide Area Network), and the like). Then, the program module 1093 and the program data 1094 may be read out from another computer by the CPU 1020 via the network interface 1070.

Although the above has explained the embodiment to which the invention made by the present inventors is applied, the present invention is not limited by a description and figures that compose a part of the disclosure of the present invention based on the present embodiment. That is to say, other embodiments, examples, operating techniques, and the like that are implemented by, for example, a person skilled in the art based on the present embodiment are all encompassed within the scope of the present invention.

REFERENCE SIGNS LIST

1, 1A, 1B, 1C Signal analysis device
1P Diarization device
10 Estimation unit
11, 11P Frequency domain conversion unit
12, 12P Feature extraction unit
13, 13P Storage unit
14 Posterior probability updating unit
14P Sound source position occurrence probability estimation unit
15 Sound source existence probability updating unit
16 Sound source position probability updating unit
17, 15P Diarization unit
18 Sound source localization unit
19 Mask estimation unit

The invention claimed is:

1. A signal analysis device, comprising:

estimation circuitry that models a signal source position occurrence probability matrix Q using a product of a signal source position probability matrix B and a signal source existence probability matrix A, and estimates at least one of the signal source position probability matrix B and the signal source existence probability matrix A based on the modeling, the signal source position occurrence probability matrix Q including probabilities of arrival of a signal from each signal source position candidate per frame, which is a time section, with respect to a plurality of signal source position candidates, the signal source position probability matrix B including probabilities of arrival of a signal from each signal source position candidate per signal source with respect to a plurality of signal sources, wherein the plurality of signal sources are obtained by microphones, the signal source existence probability matrix A including existence probabilities of a signal from each signal source per frame, sound source localization circuitry that performs sound source localization based on the signal source position probability matrix B, and circuitry that performs sound source separation based on the sound source localization.

2. The signal analysis device according to claim 1, wherein the estimation circuitry estimates at least one of the signal source position probability matrix B and the signal source existence probability matrix A by applying a mixture distribution that uses the modeled signal source position occurrence probability matrix Q as a mixture weight to an observed signal with respect to a plurality of frames.

3. The signal analysis device according to claim 1, wherein the estimation circuitry estimates at least one of the signal source position probability matrix B and the signal source existence probability matrix A so that a product of the signal source position probability matrix B and the signal source existence probability matrix A approximates the signal source position occurrence probability matrix Q.

4. The signal analysis device according to claim 1, further comprising:

diarization circuitry that determines that, with respect to at least one frame of at least one signal source, a signal from the signal source exists in the frame when an existence probability of the signal from the signal source in the frame included in the signal source existence probability matrix A estimated by the estimation circuitry is larger than a predetermined threshold or is equal to or larger than the predetermined threshold, and/or determines that, with respect to at least one frame of at least one signal source, a signal from the signal source does not exist in the frame when an existence probability of the signal from the signal source in the frame included in the signal source existence probability matrix A estimated by the estimation circuitry is smaller than the predetermined threshold or is equal to or smaller than the predetermined threshold.

5. The signal analysis device according to claim 1, wherein the sound source localization circuitry, when it is assumed that Cartesian coordinates, spherical coordinates, or a partial coordinate thereof of each signal source position candidate is known, performs sound source localization to estimate coordinates of signal sources by regarding a position probability of a signal from each signal source included in the signal source position probability matrix B as a probability that a position of each signal source is a position candidate of each signal source, and using coordinates of a sound source position candidate that maximizes a position probability of a signal from an $n^{th}$ signal source as estimated values of coordinates of the $n^{th}$ signal source.

6. The signal analysis device according to claim 1, further comprising:

mask estimation circuitry that estimates a mask indicating which signal source exists at each time-frequency point using existence probabilities of a signal from each signal source included in the signal source existence probability matrix A and position probabilities of a signal from each signal source included in the signal source position probability matrix B.

7. A signal analysis method executed by a signal analysis device, the signal analysis method comprising:

modeling a signal source position occurrence probability matrix Q using a product of a signal source position probability matrix B and a signal source existence probability matrix A, and estimating at least one of the signal source position probability matrix B and the signal source existence probability matrix A based on the modeling, the signal source position occurrence probability matrix Q including probabilities of arrival of a signal from each signal source position candidate per frame, which is a time section, with respect to a plurality of signal source position candidates, the signal source position probability matrix B including probabilities of arrival of a signal from each signal source position candidate per signal source with respect to a plurality of signal sources, wherein the plurality of signal sources are obtained by microphones, the signal source existence probability matrix A including existence probabilities of a signal from each signal source per frame;

performing sound source localization based on the signal source position probability matrix B; and performing sound source separation based on the sound source localization.

8. A non-transitory computer-readable medium storing thereon a signal analysis program for causing a computer to function as the signal analysis device according to claim 1.

* * * * *